US009556814B2

(12) United States Patent
Radeczky

(10) Patent No.: US 9,556,814 B2
(45) Date of Patent: Jan. 31, 2017

(54) METHOD FOR CONTROLLING PRESSURE IN A HIGH-PRESSURE REGION OF AN INTERNAL COMBUSTION ENGINE

(71) Applicant: CONTINENTAL AUTOMOTIVE GMBH, Hannover (DE)

(72) Inventor: Janos Radeczky, Wenzenbach (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 87 days.

(21) Appl. No.: 14/379,351

(22) PCT Filed: Feb. 11, 2013

(86) PCT No.: PCT/EP2013/052663
§ 371 (c)(1),
(2) Date: Aug. 18, 2014

(87) PCT Pub. No.: WO2013/120797
PCT Pub. Date: Aug. 22, 2013

(65) Prior Publication Data

US 2015/0027415 A1 Jan. 29, 2015

(30) Foreign Application Priority Data

Feb. 16, 2012 (DE) ..... 10 2012 202 344

(51) Int. Cl.
*F02D 41/20* (2006.01)
*F02D 41/38* (2006.01)
*F02M 51/06* (2006.01)

(52) U.S. Cl.
CPC ..... *F02D 41/2096* (2013.01); *F02D 41/3809* (2013.01); *F02D 41/3872* (2013.01); *F02M 51/0603* (2013.01)

(58) Field of Classification Search
CPC ..... F02M 47/027; F02M 51/0603; F02M 63/0026; F02M 2200/21; F02D 41/2096; F02D 41/3872; F02D 41/3863; F02D 19/0673; F02D 19/0684; F02D 2041/2051
See application file for complete search history.

(56) References Cited

U.S. PATENT DOCUMENTS 5,893,350 A * 4/1999 Timms ..... F02M 45/04 123/467
6,345,606 B1 * 2/2002 Ricci-Ottati ..... F02D 41/3872 123/456

(Continued)

FOREIGN PATENT DOCUMENTS

CN 1630777 A 6/2005 ..... F02D 41/20
CN 101094979 A 12/2007 ..... F02D 35/02

(Continued)

OTHER PUBLICATIONS

Chinese Office Action, Application No. 201380009674.1, 5 pages, Jan. 6, 2016.

(Continued)

*Primary Examiner* — Sizo Vilakazi
(74) *Attorney, Agent, or Firm* — Slayden Grubert Beard PLLC

(57) ABSTRACT

A method for controlling pressure in a high-pressure region of an internal combustion engine includes adjusting a fuel outflow from the high-pressure region into a low-pressure region by means of an injector, which has a control valve adjusted by a piezo actuator and a control chamber. The method includes charging the piezo actuator by a first signal such that the control valve is moved from a closed position to a partially open position and fuel flows out from the high-pressure region into the low-pressure region, discharging the piezo actuator by a second signal such that the control valve is moved into the closed position, and partially (Continued)

discharging the piezo actuator by a third signal after the first signal and before the second signal. The method provides pressure control in the high-pressure region via an injector with high reliability even at high rail pressure.

20 Claims, 5 Drawing Sheets

(56) References Cited

U.S. PATENT DOCUMENTS

| | | | | |
|---|---|---|---|---|
| 6,420,817 | B1 * | 7/2002 | Ricci-Ottati | F02D 41/2096 123/498 |
| 6,867,531 | B2 * | 3/2005 | Rueger | F02D 41/2096 123/478 |
| 7,802,561 | B2 | 9/2010 | Beilharz et al. | 123/498 |
| 8,051,839 | B2 | 11/2011 | Spadafora et al. | 123/498 |
| 2005/0284443 | A1 | 12/2005 | Huber et al. | 123/299 |
| 2008/0006243 | A1 * | 1/2008 | Fujii | F02D 41/2096 123/472 |
| 2009/0184176 | A1 * | 7/2009 | Cooke | F02D 41/2096 239/102.2 |
| 2013/0026257 | A1 * | 1/2013 | Jalal | F02M 51/0603 239/585.5 |

FOREIGN PATENT DOCUMENTS

| | | | | |
|---|---|---|---|---|
| CN | 101397962 | A | 4/2009 | F02D 41/20 |
| DE | 19954023 | A1 | 5/2000 | F02D 41/20 |
| DE | 102005001579 | A1 | 7/2006 | F02D 41/20 |
| DE | 102005012998 | B3 | 9/2006 | F02D 41/38 |
| DE | 102007054814 | A1 | 5/2009 | F02D 41/20 |
| DE | 102008001602 | A1 | 11/2009 | F02D 41/20 |
| DE | 102008040629 | A1 | 1/2010 | F02D 41/22 |
| WO | 2013/120797 | A1 | 8/2013 | F02D 41/20 |

OTHER PUBLICATIONS

International Search Report and Written Opinion, Application No. PCT/EP2013/052663, 16 pages, May 14, 2013.

* cited by examiner

METHOD FOR CONTROLLING PRESSURE IN A HIGH-PRESSURE REGION OF AN INTERNAL COMBUSTION ENGINE

CROSS-REFERENCE TO RELATED APPLICATIONS

This application is a U.S. National Stage Application of International Application No. PCT/EP2013/052663 filed Feb. 11, 2013, which designates the United States of America, and claims priority to DE Application No. 10 2012 202 344.5 filed Feb. 16, 2012, the contents of which are hereby incorporated by reference in their entirety.

TECHNICAL FIELD

The invention relates to a method for controlling pressure in a high-pressure region of an internal combustion engine by means of adjusting the quantity of fuel flowing out from the high-pressure region into a low pressure region by way of an injector that comprises a control valve, which can be adjusted by means of a piezo actuator, and a control chamber and also a control device of a motor vehicle that is embodied for the purpose of performing the method in accordance with the invention for controlling pressure.

BACKGROUND

In particular, the method in accordance with the invention relates to controlling pressure in a high-pressure region of a common rail injection system. In the case of this type of injection system, the process of generating pressure that is required to inject the fuel is decoupled from the process of injecting fuel into the combustion chamber of the internal combustion engine. The fuel is conveyed independently of the injection cycle of the internal combustion engine by way of a high-pressure pump into a storage unit, the so-called rail. The rail is connected to the fuel injectors of the engine by way of high-pressure lines. The injectors are actuated in an electrical manner by way of a control and said injectors ensure that fuel is injected from the high-pressure region into the combustion chamber of the engine.

The common rail system is divided primarily into a low-pressure region and a high-pressure region. The low pressure region comprises inter alia a fuel tank and fuel lines. The high-pressure region comprises inter alia a high pressure pump, a common rail, fuel injectors and high pressure lines.

A typical piezo servo injector comprises as its main components a holding body, an injection nozzle, a control valve and a control chamber. By way of a pressure change in the control chamber of the injector, the valve needle of the injection nozzle can be raised or lowered and the injection nozzle can consequently be opened or closed respectively. The pressure in the control chamber can be adjusted by way of controlling the control valve. The control chamber is connected on the one hand by way of the control valve to the low-pressure region and on the other hand by way of an inlet restrictor to the high-pressure region of the injection system.

In general, the manner in which a piezo servo injector functions can be divided into four states. In the idle state, the injector is not actuated. The control valve is closed and the pressure from the high-pressure region builds up in the control chamber by virtue of the in-flow of fuel from the rail. The force that is exerted on the valve needle by virtue of the pressure in the control chamber urges the valve needle head into the valve seat of the injection nozzle; the injection nozzle is closed in this position. As the injection process commences, the piezo actuator of the injector is charged by way of a charging signal and the control valve is consequently opened. The fuel can flow out of the control chamber into the low-pressure region. The inlet restrictor ensures that the pressure reduction in the control chamber cannot be compensated for immediately by means of the fuel pressure in the rail. The pressure reduction in the control chamber ensures as a consequence that the closing force acting of the needle valve reduces and the injection nozzle is opened. In the open state, the fuel is injected from the rail into the combustion chamber of an associated cylinder. As the injection process is terminated, the piezo actuator is discharged by way of a discharge signal and the control valve is consequently closed. As a result, the pressure in the control chamber is equalized to that of the fuel pressure prevailing in the rail. The increase in pressure in the control chamber ensures that the closing force that is acting on the needle valve in turn increases and the injection nozzle is consequently closed.

In order to meet the rising demands to reduce the pollutant emissions from internal combustion engines, solutions for fuel injection systems can be found that entail new requirements for maintaining system performance. One measure for reducing CO2 emissions is for example to reduce the injection leakage of a fuel injector. However, this is encumbered with the problem that lack of leakage-tightness in a fuel injector can lead to the undesired injection of fuel into the combustion chamber of a cylinder. The undesired injected fuel is not combusted properly in the cylinder and this leads as a result to an increase in pollutant emissions.

A known measure for reducing injector leakage is the reduction of pressure in the common rail system of the internal combustion engine. However, the additional components that are required for this purpose, such as for example an actuator for controlling the pressure in the rail, lead to a considerable increase in the costs of the system of the internal combustion engine.

In the case of current systems, a pressure reduction occurs in the rail by means of a continuous injector leakage from a high-pressure region into a low-pressure region of the internal combustion engine. As a consequence, it is ensured that the customer requirements with regard to a pressure reduction gradient in the high-pressure region are met. The use of injectors that have a very low or no continuous leakage, in particular in the case of fuel injectors having a control valve, which is actuated by way of a piezo actuator, the period of pressure reduction in the high-region of the internal combustion engine, for example in the case of negative load cycles, is sometimes too long.

In contrast to a control valve that is actuated in an electromagnetic manner, the use of a piezo actuator renders it possible to specify the position of the valve actuator in a defined manner.

Below a predetermined pressure value at which the continuous leakage is no longer sufficient for the desired pressure reduction gradient, it is possible to generate an additional switching leakage by means of purposefully controlling the piezo actuator of the injector (part stroke of the control valve). Thus, a pressure reduction gradient is adjusted between the high-pressure region and the low-pressure region, by means of which a pressure reduction can be achieved in the high-pressure region of the internal combustion engine. This method is also described as a LAPD method (Leakage Amplified Pressure Decay).

However, this type of control can no longer be used above a critical pressure value owing to an increased risk of an undesired injection of fuel.

When controlling the injector in the LAPD mode, the restrictor region of the control valve is exploited. The position of the control valve in the part stroke is approached in such a manner that the opened cross section leads to a pressure reduction in the high-pressure region and the pressure reduction in the control chamber of the injector does not exceed the critical value of a force reversal on the injector needle.

However, the purposeful approach and stabilization of a part stroke position of the control valve with a conventional flow/voltage profile for the purpose of controlling the piezo actuator or rather with the known LAPD method is only possible in a limited pressure range (e.g. up to approx. 1200 bar) owing to the elasticity/rigidity of the piezo actuator.

SUMMARY

One embodiment provides a method for controlling pressure in a high-pressure region of an internal combustion engine by means of adjusting the quantity of fuel flowing out from the high-pressure region into a low-pressure region by way of an injector that comprises a control valve, which can be adjusted by way of a piezo actuator, and a control chamber: having the following steps that are to be performed in the sequence mentioned: (a) charging the piezo actuator with a first signal so that the control valve is moved from a closed position into a partially open position and fuel flows out of the high-pressure region into the low-pressure region, (b) discharging the piezo actuator with a second signal so that the control valve is moved into the closed position, and (c) partially discharging the piezo actuator with a third signal after the first signal and before the second signal.

In a further embodiment, fuel is not injected into the combustion chamber of the internal combustion engine during the method.

In a further embodiment, the third signal is selected so that an essentially stable control valve position is set.

In a further embodiment, the third signal is selected in such a manner that an essentially stable pressure difference can be set in the control chamber in comparison to the pressure in the high-pressure region.

In a further embodiment, the point in time at which the third signal commences is selected in such a manner that a pressure difference between the control chamber and the high-pressure region corresponds at this point in time to a predetermined value.

In a further embodiment, at least one characteristic can be set from the group: amplitude, duration and temporal progression at least of one of the signals.

In a further embodiment, the method comprises the further steps: (a) specifying a desired value for the electrical voltage at the piezo actuator, (b) monitoring the electrical voltage at the piezo actuator, and (c) adjusting the electrical voltage at the piezo actuator to the desired value by means of controlling the piezo actuator with a control signal.

In a further embodiment, the signal is the control signal.

In a further embodiment, the control signal is an additional signal that is dependent upon the signal.

In a further embodiment, the piezo actuator is actuated with the control signal after the third signal and before the second signal.

In a further embodiment, the method includes the following steps: (a) monitoring the electrical voltage at the piezo actuator, (b) evaluating the monitored voltage, and (c) immediately discharging the piezo actuator in the event that it is detected that an increase in voltage at the piezo actuator exceeds a predetermined value.

In a further embodiment, the electrical voltage at the piezo actuator is sampled continuously at a sampling rate that is greater than or equal to 10 kHz.

In a further embodiment, the electrical voltage at the piezo actuator is sampled continuously at a sampling rate that is greater than or equal to 100 kHz.

Another embodiment provides a control device of a motor vehicle, said control device being embodied so as to perform the method for controlling pressure as disclosed above.

BRIEF DESCRIPTION OF THE DRAWINGS

Example embodiments of the invention are explained below with reference to the figures, in which.

DETAILED DESCRIPTION

Figure 1A:
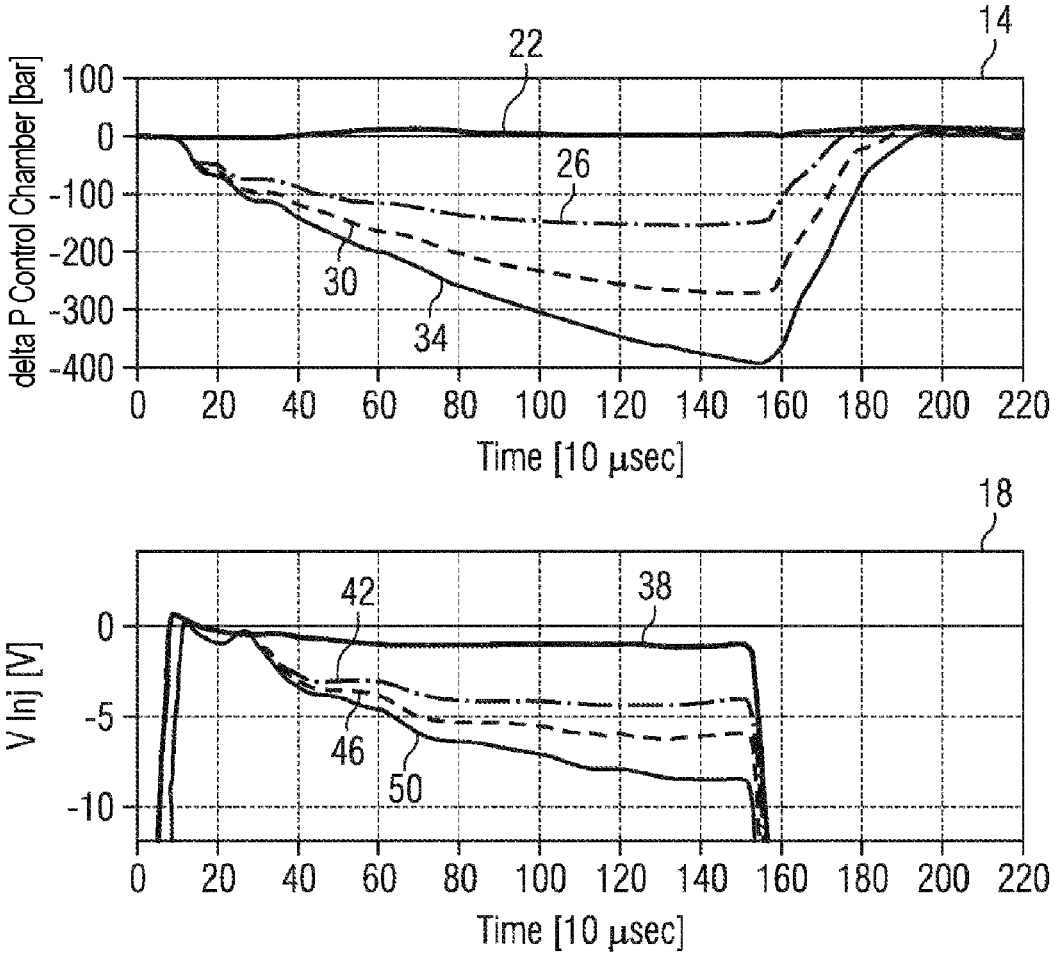
FIG. 1*a* is a diagram illustrating the pressure reduction in the control chamber of a piezo fuel injector and the voltage progression at the piezo actuator when using a method for partially opening a control valve according to the prior art.

Some embodiments of the invention provide an improved method for controlling pressure in a high-pressure region of an internal combustion engine that can also be used in the case of a high rail pressure and by means of which the pressure reduction in the high-pressure region can be accelerated and/or the probability of an undesired injection of fuel can be reduced.

The method for controlling pressure in a high-pressure region of an internal combustion engine by means of adjusting the quantity of fuel flowing out from the high-pressure region into a low-pressure region by way of an injector that comprises a control valve, which can be adjusted by way of a piezo actuator, and a control chamber, includes the following steps that are to be performed in the sequence mentioned:

- Charging the piezo actuator with a first signal so that the control valve is moved from a closed position into a partially open position and fuel flows out of the high-pressure region into the low-pressure region,
- Discharging the piezo actuator with a second signal so that the control valve is moved into the closed position,
- Partially discharging the piezo actuator with a third signal after the first signal and before the second signal.

Embodiments of the invention are based on the knowledge that, when controlling the piezo actuator using the known LAPD method, pressure is reduced in the control chamber by means of the pressure drop in the control chamber, as a consequence of which the closing force that is acting upon the piezo actuator by means of the control valve is reduced. This process of relieving the pressure causes the piezo actuator or rather the entire drive to continue to expand which leads to the control valve opening further and consequently in turn to the pressure on the piezo actuator being further relieved. As a result of relieving the pressure on the actuator, the probability increases of an undesired injection of fuel into the combustion chamber of the internal combustion engine.

Depending upon the rigidity of the piezo actuator, the control voltage and the force required for opening the control valve, the idle position of the piezo actuator occurs at different partial stroke positions. In the critical pressure region, a very high initial voltage is required to open the valve so that, after the control chamber pressure has reduced and the pressure on the piezo actuator has been relieved, the probability for an undesired injection of fuel is drastically increased.

By virtue of the partial discharge of the piezo actuator with the third signal, it is possible for the pressure relief of the piezo actuator to be too intense and consequently the probability of an undesired injection of fuel into the combustion chamber can be reduced. An excess charge can be applied for the purpose of opening the control valve. After the control valve has been opened, the electrical charge that said control valve conveys to the piezo actuator can be reduced by virtue of a partial discharge. As a consequence, it is possible to interrupt the sequence: pressure reduction in the control chamber, pressure relief of the piezo actuator and consequently the control valve opening further, further pressure reduction in the control chamber, further pressure relief of the piezo actuator etc. A stable partially open position of the control valve or rather the servo valve can be set using this method.

In comparison to known methods, it is thus possible to set a stable partially open position of the control valve in the case of a considerably increased stroke of the piezo actuator. This leads to a quicker reduction of pressure in the high-pressure region or rather in the rail of the injection system.

The term 'piezo actuator' can be understood to mean equally a piezo drive or a piezo actuator. The charging or discharging of the piezo actuator is performed in a known manner by way of the supply or discharge of an electrical charge. This can be achieved by means of applying a corresponding electrical field to the piezo actuator. The signals to charge and discharge or rather partially discharge can consequently be current signals or voltage signals or rather a combination of said signals. The term 'high-pressure region' is to be understood to mean in particular the pressure region in the common rail of the injection system of the internal combustion engine, in particular of a diesel combustion engine.

The duration of the signal, the temporal progression and the amplitude of the charge signal or rather discharge signal can be adapted to suit the characteristic or rather age-related properties of the piezo actuator being used and/or a state of the internal combustion engine. In particular, the signals can be adapted to suit the elasticity or rather rigidity and/or mechanical and/or electrical characteristics of the piezo actuator.

The signals for controlling the piezo actuator can be generated and/or provided by means of the vehicle control or by means of a driver circuit or rather the output stage. In this case, it is possible that in particular one or multiple driver circuits or output stages are involved that are allocated in each case to an injector or a group of injectors.

The third signal for the purpose of partially discharging the piezo actuator is applied to the piezo actuator after the end of the first signal and before the commencement of the second signal, in other words after the initial partial opening of the control valve and before the control valve is closed completing an individual control step by means of discharging the piezo actuator. In order to optimize the pressure control in the rail or rather in the high-pressure region of the injection system, it is also feasible that the first and third and/or the third and second signal slightly overlie one another with respect to time.

In one embodiment using the method, fuel is not injected into the combustion chamber of the internal combustion engine. This has the advantageous effect that no additional or undesired administered fuel is injected into the combustion chamber of the internal combustion engine. This reduces the fuel consumption and reduces the pollutant emission of the engine. In particular, fuel is not injected between the first and the second signal.

In one embodiment, the third signal is selected so that an essentially stable control valve position is set. Consequently, a stable pressure difference can be set between the rail or rather the high-pressure region of the injection system and the control chamber. This has the advantageous effect that it is possible to prevent the piezo actuator from creeping or rather expanding or bulging in an undesirable manner as a result of pressure changes in the control chamber. The term 'an essentially stable control valve position' is understood to mean in particular an open position of the control valve that when viewed over a period of time does not change or only changes in a predetermined range so that the pressure difference between the high-pressure region and the control chamber is only slightly affected by this change. It is in particular provided that the control valve position is set after the third signal and is held until the piezo actuator is actuated with a next signal in particular with the second signal, or rather said position changes only in a limited range.

The third signal may be selected so that an essentially stable pressure difference with respect to the high-pressure region occurs in the control chamber. In particular, the third signal can be selected for the partial discharge of the piezo actuator in such a manner that per unit of time the quantity of fuel that is flowing from the high-pressure region into the control chamber and the quantity of fuel that is flowing out of the control chamber into the low-pressure region are identical.

In the case of a stable pressure difference between the control chamber and the rail or rather the high-pressure region, it is possible to reduce the probability of an undesired injection by means of a non-intended stroke of the injector needle.

The use of a third signal for the partial discharge of the piezo actuator has in particular the advantage that the pressure difference in the control chamber or rather the control valve position is more stable when viewed over a period of time than in a method that does not use a corresponding signal for the partial discharge process. The term 'more stable' means in this case for example that the pressure difference or rather the valve position in comparison to known methods changes over the temporal progression in a more narrowly limited range.

By virtue of the purposeful control of the piezo actuator with the third signal for the purpose of the partial discharge process, the LAPD range or rather the control range of the control valve can be extended. In particular, it is consequently possible in comparison to known methods to produce a stable position of the control valve during a greater stroke and/or greater pressure difference in the control chamber with respect to the rail or rather the high-pressure region. Furthermore, it is advantageous that a greater through-flow can be set at the control valve or rather the servo valve. It is thus possible to achieve in particular a greater pressure reduction gradient in the system.

In a further embodiment, the point in time at which the third signal commences is selected so that a pressure difference between the control chamber and the high-pressure chamber corresponds at this moment in time to a predetermined value. In particular, a pressure difference can be provided that is in the range from 100 bar to 400 bar, in particular in the range from 150 to 300 bar. Consequently, it is possible to select a pressure value that corresponds to a desired state or a system requirement of the internal combustion engine. By way of example, the predetermined pressure difference can be selected in dependence upon the power requirement of the internal combustion engine. In particular, said pressure difference can be adapted to suit the pressure conditions in the high-pressure region.

In a further embodiment, at least one characteristic can be set from the group: amplitude, duration and temporal progression at least of one of the signals. Consequently, the current/voltage profile for the purpose of charging, discharging or rather partial discharging can be adapted individually to suit the characteristics of an individual piezo actuator. These characteristics can vary over the serviceable life of the internal combustion engine or rather of the injection system or as a result of exchanging injectors or rather piezo actuators or other components of the injection system. Moreover, the signals can consequently be purposefully predetermined by a control process or rather a driver circuit and/or can be set to a predetermined opening or rather closing behavior of the control valve. The signals can in particular be also sequences of voltage pulses and/or current pulses. For example, the signals can be PWM signals (pulse width modulation signals). The temporal progression can be designed for example in such a manner so that a trapezoidal, rectangular and/or triangular signal procession is produced.

In one embodiment, the method comprises the further steps of:

Specifying a desired value for the electrical voltage at the piezo actuator,

Monitoring the electrical voltage at the piezo actuator, and

Adjusting the electrical voltage at the piezo actuator to the desired value by means of controlling the piezo actuator with a control signal.

In particular, it can be provided that the deviation of the electrical voltage at the piezo actuator from the desired value is determined and the piezo actuator is actuated with the control signal in dependence upon the deviation. The control signal can by way of example be generated and/or provided in the vehicle control system or in a driver circuit.

It is possible by virtue of adjusting the electrical voltage of the piezo actuator to actively control the position of the control valve. It is to be emphasized that the value of the electrical voltage at the piezo actuator is correlated with the stroke of the control valve. In order to determine the position of the control valve, it is possible to monitor the electrical voltage continuously. If the voltage value deviates by virtue of the change of the counterforce as a result of a pressure change in the control chamber beyond a defined value from the desired value, the piezo actuator is partially charged or discharged with a control signal. The control signal can be generated and/or provided by the driver control system or by a driver circuit or rather output stage. As a consequence, it is possible to actively control the position of the control valve. In addition, there is also the possibility of adapting the physical characteristics of the piezo actuator. In particular, it is consequently possible to determine a value for the rigidity of the piezo actuator. This value can then be used for the purpose of the optimal control of the injector for the injection cycles.

It is possible by virtue of continuously monitoring the electrical voltage at the piezo actuator to react rapidly to changes and by virtue of re-adjusting the voltage by way of the provision of a new control signal to counteract a threatened injection of fuel and/or to maintain the voltage at a stable level. In particular, it is possible by way of controlling the electrical voltage at the piezo actuator to control the position of the control valve in a defined range with adequate spacing for the injection of fuel. It is possible for this purpose to continuously re-adjust or rather control the piezo voltage.

The third signal may be the control signal. As an alternative, the control signal is an additional signal that is independent from the third signal. The additional signal can for example be generated and/or provided by the vehicle control system or an additional control system or rather the driver circuit that is allocated to the injector. The control signal can be predetermined in dependence upon the desired value and/or actual value of the electrical voltage at the piezo actuator. Insofar as the third signal that is used for the partial discharge of the piezo actuator is also used as the control signal for adjusting the electrical voltage of the piezo actuator, the third signal can be used in addition to being used for the partial discharge process also for the partial charging of the piezo actuator.

In one embodiment, the piezo actuator is actuated with the control signal after the third signal and before the second signal.

In a further embodiment, the method comprises the following steps:

Monitoring the electrical voltage at the piezo actuator,

Evaluating the monitored voltage, and

Immediately discharging the piezo actuator in the event that it is detected that an increase in voltage at the piezo actuator exceeds a predetermined value.

The forces at the control valve can be determined by means of continuously monitoring the electrical voltage at the piezo actuator. In particular, the voltage can be sampled for monitoring purposes at a sampling frequency that is greater than or equal to 10 kHz or even greater than or equal to 100 kHz. It is likewise possible by means of continuously monitoring the electrical voltage to detect and evaluate as quickly as possible any changes in the temporal progression of the voltage. Insofar as the increase in voltage exceeds a predetermined value, the piezo actuator can be discharged immediately and the injection of fuel prevented.

If an undesired injection of fuel occurs during the pulse, this can be detected by way of the force change at the piezo actuator and consequently by way of detecting the increase in the electrical voltage at the actuator. The needle movement (needle opening) pushes a pressure wave ahead of it that acts at a counterforce change on the piezo actuator. The needle opening or rather the opening of the injection nozzle can be detected in the case of this control mode.

The above mentioned object is likewise achieved by virtue of a control device of a motor vehicle having the features of claim 14. The control device is embodied for the purpose of performing the method in accordance with the invention for controlling pressure in accordance with one of the preceding claims.

FIG. 1*a* illustrates in the diagram 14 with the curves 22, 26, 30 and 34 the temporal progression of the pressure in the control chamber compared to the pressure in the rail of an injection system of an internal combustion engine when using an LAPD method according to the prior art. The diagram 18 illustrates with the curves 38, 42, 46 and 50 the temporal progression of the electrical voltage at the piezo actuator corresponding to the pressure progression in diagram 14. The different pressure progressions in diagram 14 are as a result of a respective different control of the piezo actuator with the first signals S10 in FIG. 1*b*. The different voltage progressions in diagram 18 are influenced by the pressure in the control chamber on the piezo actuator. Corresponding curve pairs for pressure and voltage progression are 22/38, 26/42, 30/46 and 34/50. It is evident that, after the piezo actuator has been charged, the pressure values in the control chamber clearly diverge at approx. 100 μsec. This is a result of the piezo actuator being charge with different magnitudes of charge so that the control valve achieves different opening stroke positions. The signal progression 22 or rather 38 represents a temporal progression after the actuator has been charged with a first signal S10, wherein the control valve has not been opened. The signal progressions 34 or rather 50 demonstrate on the other hand a temporal progression after the actuator has been charged with a first single S10, wherein the control valve achieves a relatively widely opened position in the restrictor region. As a result of the reciprocal effect of increasing pressure difference in the control chamber with respect to the rail and the pressure relief of the piezo actuator, the electrical voltage at the piezo actuator and the pressure in the control chamber reduce over time. At approx. 1.6 msec, the piezo actuator is discharged with a signal S20. As a result, the control valve closes, the voltage at the piezo actuator according to diagram 18 reduces and the pressure in the control chamber adjusts in accordance with to diagram 14 to the pressure in the rail of internal combustion engine. The pressure difference in the control chamber with respect to the pressure in the rail therefore reduces back towards zero. The curve 26 illustrates a pressure in the control chamber, said pressure achieving an essentially stable value at approx. 150 bar.

Figure 1B:
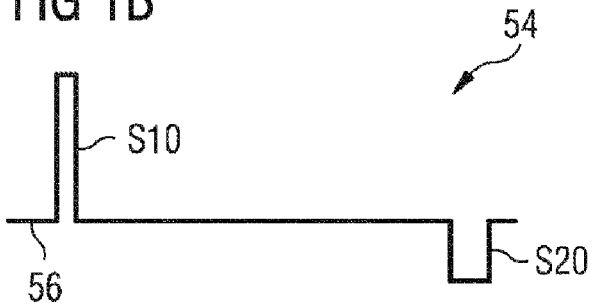
FIG. 1*b* illustrates a signal progression for charging and discharging a piezo actuator when using a method for partially opening a control valve according to the prior art.

FIG. 1*b* illustrates at 54 the signal progression for the charging and discharging the piezo actuator when using an LAPD method according to the prior art. The signal S10 is in particular a current pulse with which an electrical charge is supplied to the piezo actuator. The signal S20 is a current pulse with which an electrical charge is discharged from the piezo actuator. 56 represents a reference value for the signal progression 54, wherein the electrical charge of the piezo actuator does not change.

Figure 2A:
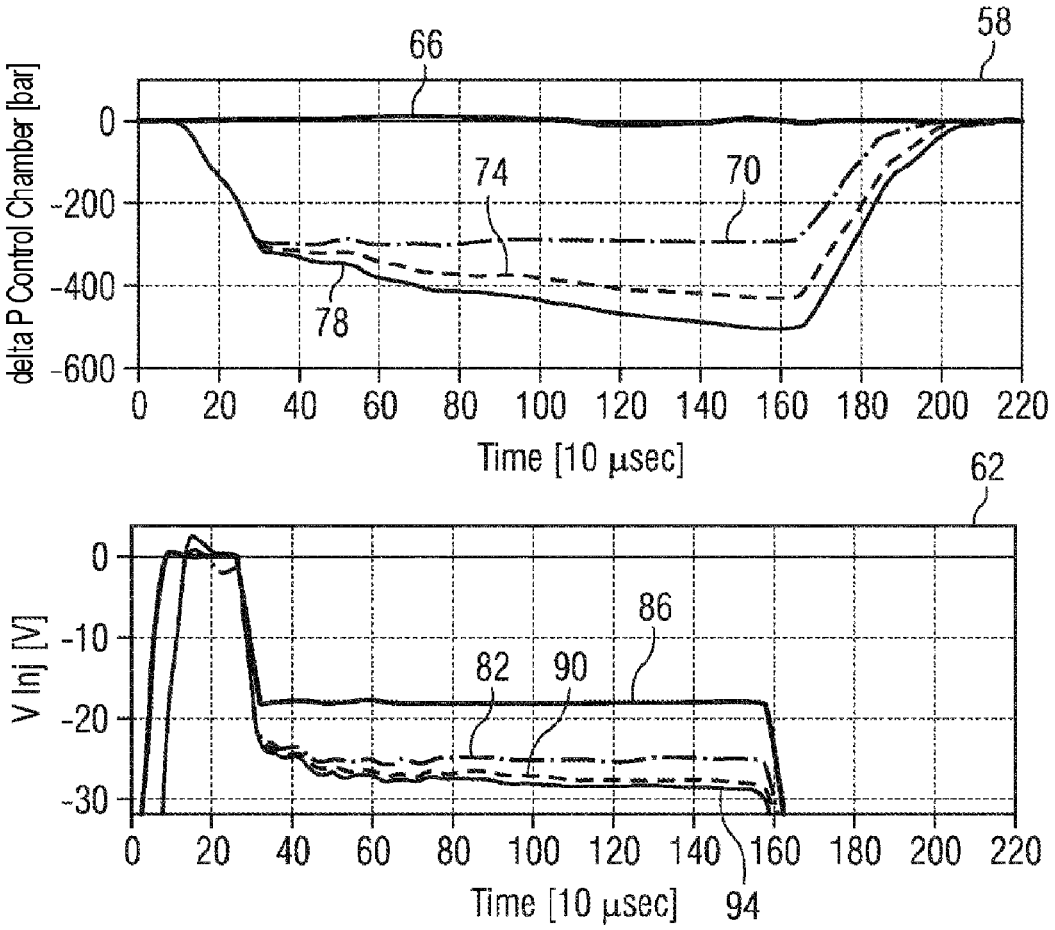
FIG. 2*a* is a diagram illustrating the pressure reduction in the control chamber of a piezo fuel injector and the voltage progression at the piezo actuator according to the disclosed method.

FIG. 2*a* illustrates in the diagram 58 with the curves 66, 70, 74 and 78 the temporal progression of the pressure in the control chamber with respect to the pressure in the rail of an injection system of an internal combustion engine according to the disclosed method. The diagram 62 illustrates with the curves 82, 86, 90, 94 the temporal progression of the electrical voltage at the piezo actuator corresponding to the pressure progression in diagram 58. Corresponding curve pairs for pressure and voltage progression re 66/86, 70/82, 74/90 and 78/94. The piezo actuator is charged with the signal S10 in FIG. 2*b* to such an extent that a large opening stroke of the control valve is set. As is evident in diagram 58 between 100 and 300 μsec, the pressure in the control chamber as a result reduces rapidly up to a pressure difference of approx. 300 bar. At approx. 300 μsec, the piezo actuator is partially charged with a signal S30. The control valve is thus moved into a further closed position, or rather the control valve is prevented from opening further as a result of the pressure reduction in the control chamber. As is evident in diagram 58, this results in a considerably decelerated pressure reduction or rather in accordance with curve 70 in an essentially stable pressure in the control chamber. The curve 70 therefore illustrates a stable pressure difference with respect to the rail of the internal combustion engine that has occurred at approx. 300 bar. The curves 74 and 78 illustrate a continuous, but in comparison to FIG. 1*a* decelerated pressure reduction in the control chamber as a result of a smaller dimensioned partial discharge of the piezo actuator with the signal S30.

Figure 2B:
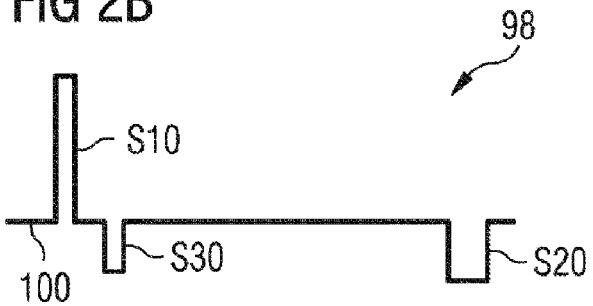
FIG. 2*b* illustrates a signal progression for charging and discharging a piezo actuator according to the disclosed method.

FIG. 2*b* illustrates at 98, the signal progression for charging and discharging the piezo actuator according to the disclosed method. The signal S10 is a current pulse with which an electrical charge is conveyed to the piezo actuator. The signal S20 is a current pulse with which an electrical charge is discharged from the piezo actuator. The signal S30 is a current pulse with which the piezo actuator is partially discharged and the control valve is consequently moved into a further closed position. A reference value for the signal progression 98 at which the electrical charge of the piezo actuator does not change is illustrated at 100.

Figure 3:
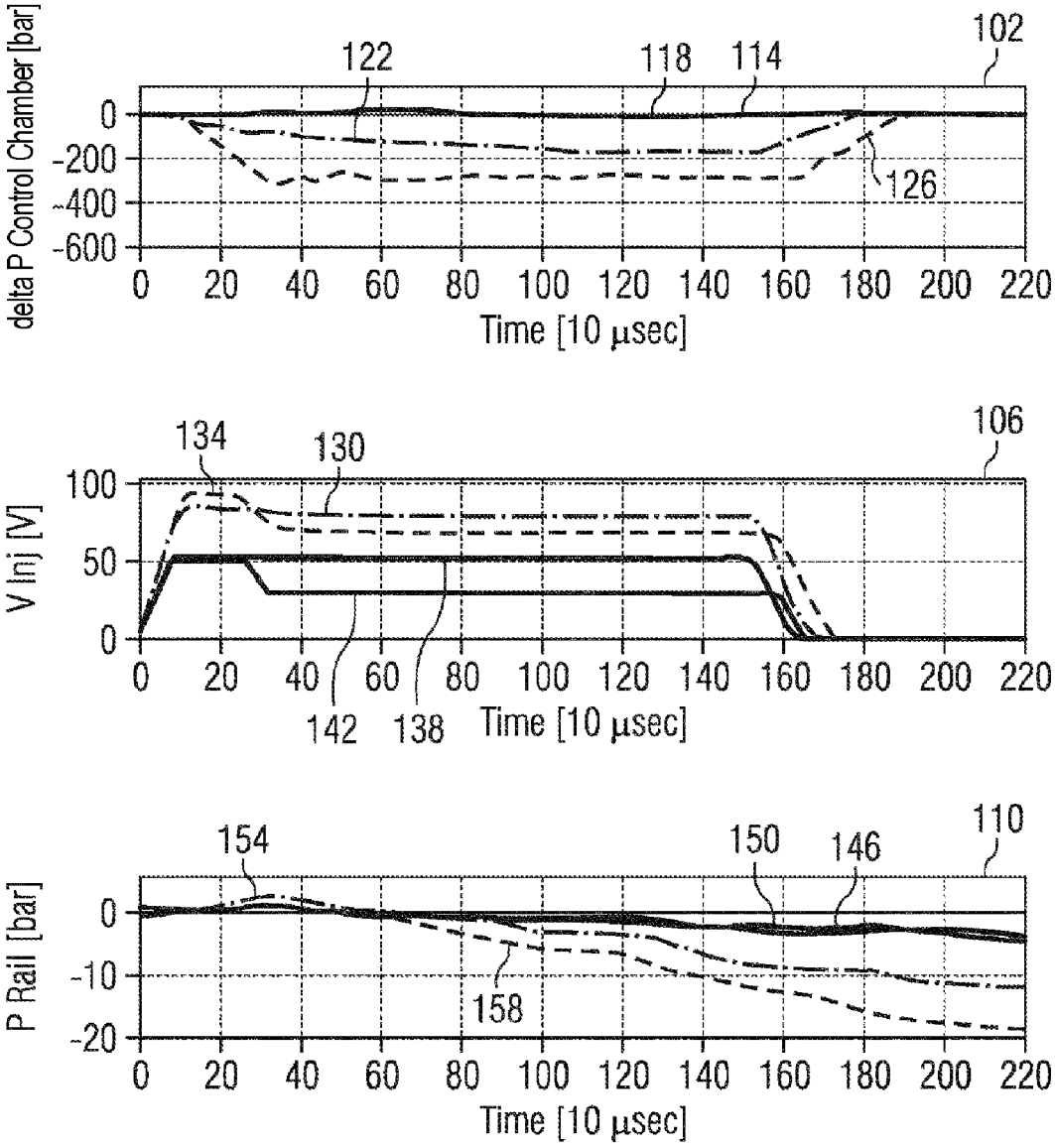
FIG. 3 is a diagram illustrating the pressure reduction in the high-pressure region in the case of a stable control valve position with a conventional and optimized signal profile.

FIG. 3 illustrates in the diagram 102 with the curves 114, 118, 122 and 126 the temporal progression of the pressure difference in the control chamber with respect to the pressure in the rail of an injection system of an internal combustion engine according to the disclosed method. The diagram 106 illustrates with the curves 130, 134, 138, 142 the temporal progression of the electrical voltage at the piezo actuator corresponding to the pressure progression in diagram 102. In addition, the diagram 110 illustrates with the curves 146, 150, 154 and 158 the temporal progression of the pressure in the rail or rather in the high-pressure region of the injection system corresponding to the pressure progression and voltage progression in the diagrams 102 and 106. Corresponding curves for the temporal progression of the control chamber pressure, voltage and rail pressure are 114/138/146, 118/142/150, 122/130/154 and 126/134/158.

The curves 122, 130 and 154 illustrate a pressure and voltage progression when using an LAPD method according to the prior art. The curves 126, 134 and 158 illustrate in comparison thereto a pressure progression and voltage progression according to the disclosed method. The pressure reduction in the rail in accordance with the curve 158 in diagram 110 illustrates a considerably accelerated pressure reduction in the rail or rather in the high-pressure region of the injection system of an internal combustion engine in contrast to the known LAPD method.

Figure 4:
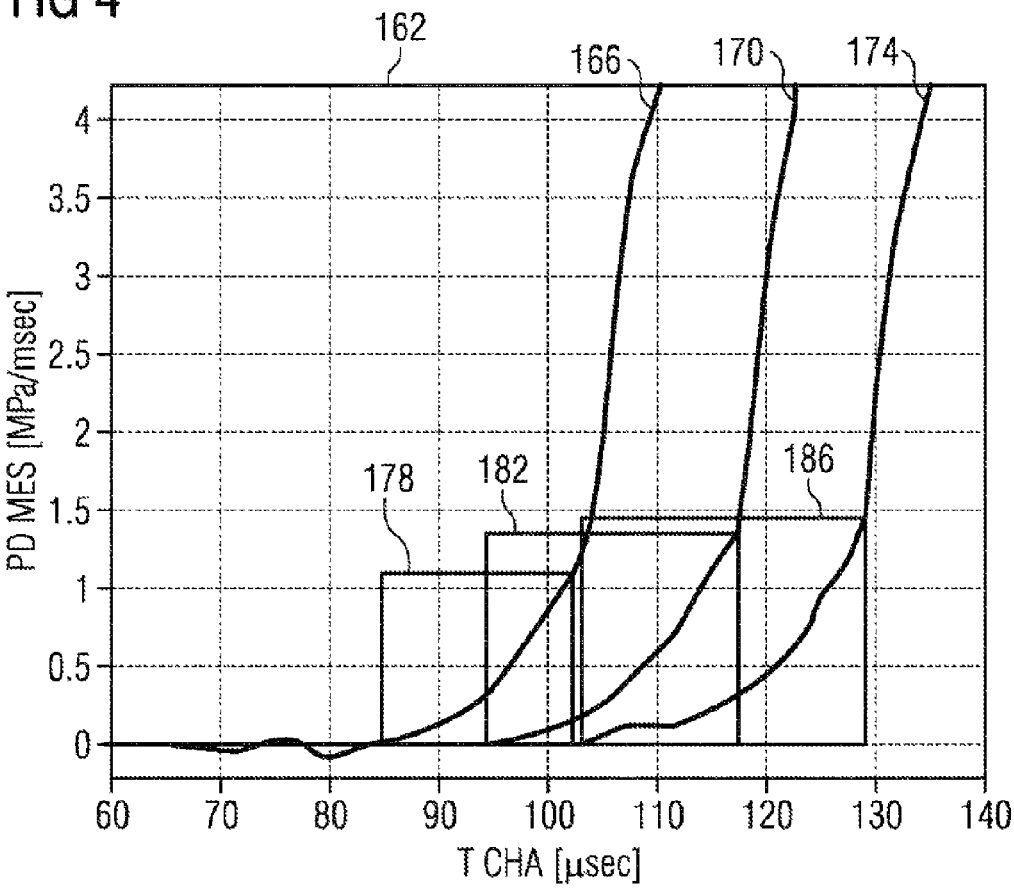
FIG. 4 is a diagram illustrating the expansion of the control range of a control valve according to the disclosed method.

FIG. 4 illustrates in diagram 162 the expansion of the LAPD range by virtue of using the disclosed method. It is evident from the rectangles that are enlarged with respect to the range 178 that higher values for the parameter T CHA can be selected and that consequently it is possible to use a greater pressure reduction rate range. The curves 166, 170 and 174 or rather the ranges 178, 182 and 186 illustrate different optimization steps that are achieved by virtue of an optimized adjustment of the signal progression for the purpose of controlling the piezo actuator. In all the curves, a pressure reduction rate in the high-pressure range, measured in MPa/msec, is plotted over a parameter T CHA, measured in μsec, which characterizes the duration of the first signal S10. The curve 166 illustrates a behavior according to the prior art. Above a value of T CHA of approx. 103

μsec, the pressure reduction rate increases steeply. This is as a result of the injection valve starting to open. The range that can be used for the LAPD method is illustrated by means of the range 178 and desired pressure reduction rates can be purposefully controlled within this range.

Figure 5:
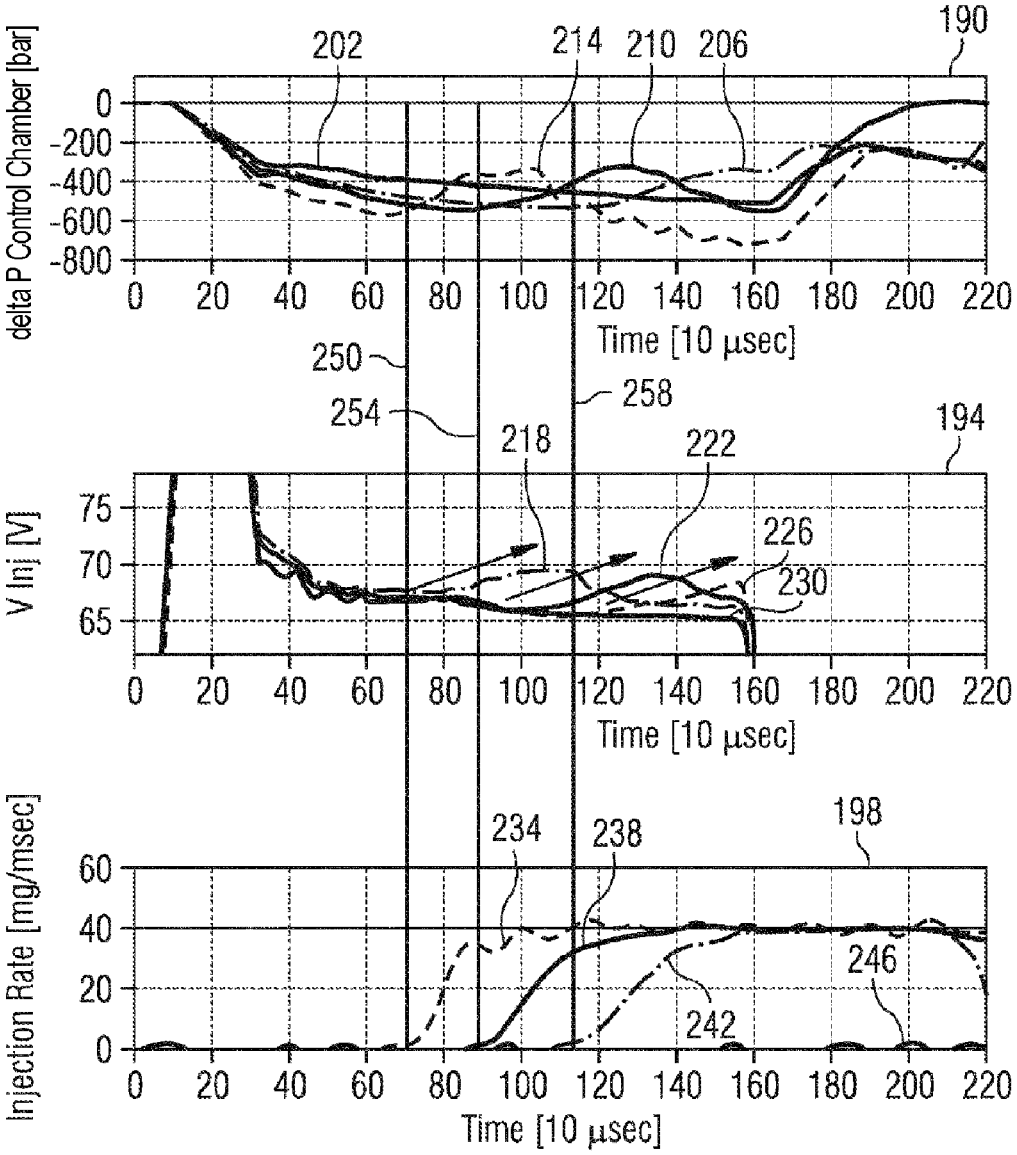
FIG. 5 is a diagram illustrating the relationship between a voltage progression at the piezo actuator, a pressure in the control chamber and a needle opening of the fuel injection.

FIG. 5 illustrates in the diagram 190 with the curves 202, 206, 210 and 214 the temporal progression of the pressure in the control chamber in comparison with the pressure in the rail of an injection system of an internal combustion engine. The diagram 194 illustrates with the curves 218, 222, 226 and 230 the temporal progression of the electrical voltage at the piezo actuator corresponding to the pressure progression in diagram 190. The diagram 198 illustrates with the curves 234, 238, 242 and 246 the temporal change of a quantity of injected fuel (injection rate) corresponding to the pressure progression and voltage progression in the diagrams 190 and 194. Corresponding curves for the temporal progression of the control chamber pressure, voltage and injection rate are 202/230/246, 206/226/242, 210/222/238 and 214/218/234.

In the diagram 190, a sudden drop in the pressure difference in the control chamber in comparison to the high-pressure range is evident in the curves 214, 210 and 206 in each case at the points in time 250 (approx. 750 μsec), 254 (approx. 900 μsec) and 258 (approx. 1130 μsec). This pressure equalization is the result of a needle opening, i.e. the injector opening. An additional pressure is exerted on the control chamber volume by means of the needle stroke. The piezo actuator is compressed by means of the pressure surge and, as is evident in diagram 194 at the corresponding points in time and marked by the arrows, the electrical voltage increases at the piezo actuator. As is evident in diagram 198, the respective needle stroke or rather the opening of the needle causes fuel to be correspondingly injected into the combustion chamber of the internal combustion engine. When using the disclosed method for the purpose of controlling pressure, the voltage increase can be observed at the piezo actuator and it is possible to counteract an injection of fuel, e.g. with a partial discharge of the piezo actuator by means of a signal S30 or by means of an additional control signal.

What is claimed is:

1. A method for controlling pressure in a high-pressure region of an internal combustion engine by adjusting a quantity of fuel flowing out from the high-pressure region into a low-pressure region via an injector that comprises a control valve adjusted by a piezo actuator, and a control chamber, wherein the method comprises:

charging the piezo actuator with a first current pulse to move the control valve from a closed position into a partially open position such that fuel flows out of the high-pressure region into the low-pressure region, discharging the piezo actuator with a second current pulse to move the control valve into the closed position, and partially discharging the piezo actuator with a third current pulse after the first current pulse and before the second current pulse.

2. The method of claim 1, wherein fuel is not injected into the combustion chamber of the internal combustion engine during the charging, discharging, and partially discharging steps.

3. The method of claim 1, wherein the third current pulse is selected that provides an essentially stable control valve position.

4. The method of claim 1, wherein the third current pulse is selected that provides an essentially stable pressure difference in the control chamber with respect to the pressure in the high-pressure region.

5. The method of claim 1, comprising commencing the third current pulse at a time at which a pressure difference between the control chamber and the high-pressure region corresponds to a predetermined value.

6. The method of claim 1, comprising setting at least one of an amplitude, a duration, and a temporal progression at least of one of the first, second, and third current pulses.

7. The method of claim 1, comprising:

specifying a desired value for the electrical voltage at the piezo actuator, monitoring an electrical voltage at the piezo actuator, and adjusting the electrical voltage at the piezo actuator to the desired value by controlling the piezo actuator with a control signal.

8. The method of claim 7, wherein the third current pulse is the control signal.

9. The method of claim 7, wherein the control signal is is dependent upon the third current pulse.

10. The method of claim 7, wherein the piezo actuator is actuated with the control signal after the third current pulse and before the second current pulse.

11. The method of claim 1, comprising:

monitoring an electrical voltage at the piezo actuator, evaluating the monitored voltage, and immediately discharging the piezo actuator in in response to detecting that an increase in voltage at the piezo actuator exceeds a predetermined value.

12. The method of claim 7, comprising continuously sampling the electrical voltage at the piezo actuator at a sampling rate greater than or equal to 10 kHz.

13. The method of claim 7, comprising continuously sampling the electrical voltage at the piezo actuator at a sampling rate greater than or equal to 100 kHz.

14. A control system of a motor vehicle having an internal combustion engine with a high-pressure region and a low-pressure region said control system comprising:

an injector comprising a control valve adjusted by a piezo actuator, and a control device comprising a processor and instructions stored in non-transitory computer-readable media and executable by the processor to control pressure in the high-pressure region of the internal combustion engine by adjusting a quantity of fuel flowing out from the high-pressure region into the low-pressure region via the injector by:

charging the piezo actuator with a first current pulse to move the control valve from a closed position into a partially open position such that fuel flows out of the high-pressure region into the low-pressure region, discharging the piezo actuator with a second current pulse to move the control valve into the closed position, and partially discharging the piezo actuator with a third current pulse after the first current pulse and before the second current pulse.

15. The control system of claim 14, wherein fuel is not injected into the combustion chamber of the internal combustion engine during the charging, discharging, and partially discharging steps.

16. The control system of claim 14, wherein the third current pulse is selected that provides an essentially stable control valve position.

17. The control system of claim 14, wherein the third current pulse is selected that provides an essentially stable pressure difference in the control chamber with respect to the pressure in the high-pressure region.

18. The control system of claim 14, wherein the control device commences the third current pulse at a time at which a pressure difference between the control chamber and the high-pressure region corresponds to a predetermined value.

19. The control system of claim 14, wherein the control device sets at least one of an amplitude, a duration, and a temporal progression at least of one of the first, second, and third current pulses.

20. The control system of claim 14, wherein the control device is further programmed to:

specify a desired value for the electrical voltage at the piezo actuator, monitor an electrical voltage at the piezo actuator, and adjust the electrical voltage at the piezo actuator to the desired value by controlling the piezo actuator with a control signal.

* * * * *